United States Patent [19]

Kotche

[11] 4,027,350

[45] June 7, 1977

[54] CLEANING PAD

[75] Inventor: Ervin Kotche, Orlando, Fla.

[73] Assignee: Ervin H. Kotche, Orlando, Fla.

[22] Filed: Apr. 29, 1976

[21] Appl. No.: 681,391

[52] U.S. Cl. ..... 15/104.93; 15/118

[51] Int. Cl.[2] ..... A47L 13/17

[58] Field of Search ..... 15/104.92, 104.93, 104.94, 15/118, 209; 106/8, 9

[56] References Cited

UNITED STATES PATENTS

| | | | |
|---|---|---|---|
| 1,267,236 | 5/1918 | Lawrence | 106/9 |
| 1,819,736 | 8/1931 | Costigan | 106/8 |
| 2,308,405 | 1/1943 | Tully | 15/104.94 |
| 2,845,650 | 8/1958 | Ashley et al. | 15/209 C |
| 3,074,099 | 1/1963 | Cameron | 15/104.94 |
| 3,293,684 | 12/1966 | Tundermann | 15/104.94 X |

*Primary Examiner*—Edward L. Roberts

[57] ABSTRACT

A buffing and cleaning pad includes a layer of steel wool which has been impregnated with a solution of crude drying oil and essence of lemon. A layer of dust cloth can be bonded to the steel wool layer by an intermediate polyethylene layer having a layer of paper mechanical bonded to each of its surfaces.

2 Claims, 2 Drawing Figures

CLEANING PAD

BACKGROUND OF THE INVENTION

A number of U.S. Patents relate to variously designed cleaning pads. U.S. Pat. No. 885,778 to Neuberger relates to pad, wherein the layers are readily separated from each other. U.S. Pat. No. 1,643,722 to Millen relates to a polishing mitt and a means for preventing a cleaning solution from coming in contact with a user's hand. U.S. Pat. No. 1,852,114 to Green relates to a renewable surface dust cloth, wherein each successive layer of paper as used can be pulled off. U.S. Pat. No. 2,230,312 to Sieb et. al. relates to a cleaning or polishing device having two different cleaning surfaces. These aforementioned patents are non-applicable to my present instant invention.

SUMMARY OF THE INVENTION

My present invention relates to a unique and novel buffing and cleaning pad.

An object of my present invention is to provide a pad having both a buffing and cleaning surface, wherein the buffing layer is saturated with an oil like substance.

A still further object of my present invention is to provide a means for the preventation of migration from the buffing to the cleaning layer.

Another object of my present invention is to provide a buffing layer adaptable for the cleaning of surfaces of furniture finishes, panels and cabinets as well as the removal of water rings, alcohol rings, scuff marks, cigarette scorches, splattered paint, packing marks and minor scratches.

Briefly, my present invention comprises a layer of steel wool which has been impregnated with a solution of crude drying oil and essence of lemon. A layer of dust cloth can be bonded to the steel wool layer by an intermediate polyethylene layer having a layer of paper mechanical bonded to each of its surfaces.

BRIEF DESCRIPTION OF THE DRAWINGS

The objects and features of the invention may be understood with references to the following detailed description of an illustrative embodiment of the invention, taken together with the accompanying drawings in which.

DESCRIPTION OF THE PREFERRED EMBODIMENT

Figure 1:
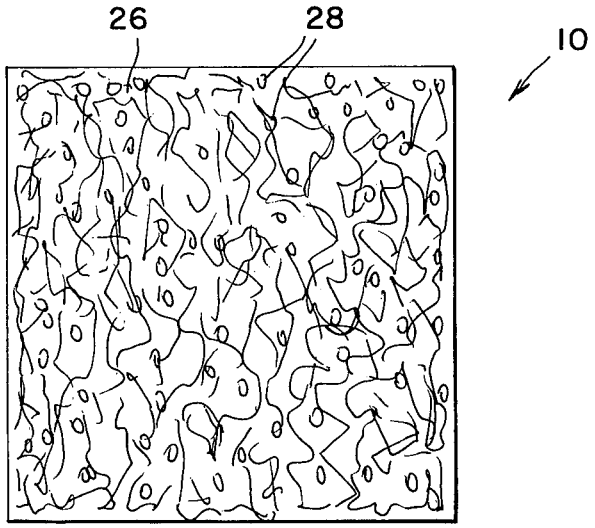
FIG. 1 illustrates a top perspective view of the buffing pad.
Figure 2:
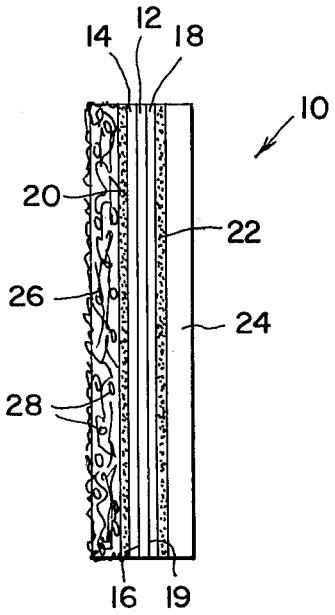
FIG. 2 illustrates a side view of the pad.

Turning now descriptively to the drawings, in which similar reference characters denote similar elements throughout the several views, FIGS. 1–2 show a buffing and cleaning pad 10 which comprises a center layer of low density polyethylene 12. A first paper layer 14 is secured to a front surface 16 of the polyethylene layer 12 and a second paper layer 18 is secured to a rear surface 19 of the polyethylene layer. A first adhesive coating 20 is deposited on the first paper layer 14. A second adhesive coating 22 is deposited on the second paper layer 18. A dust cloth 24 is adhesively secured to coating 22. A steel wool layer 26 is adhesively secured to coating 20. The steel wool layer 26 is impregnated to a point of saturation with a solution 28 of a crude drying oil and essence of lemon. The solution 28 is formed from:

| | Wt./100 lbs. |
|---|---|
| Crude Drying Oil | 99.9 |
| Essence of Lemon | 0.1 |

The pad 10 is formed for the following process. The layer of polyethylene 12 is extrusion coated between the two paper layers 14, 18. The adhesive coatings 20, 22 are deposited respectively on layers 14, 18 by passing the composite through a bath of the adhesive. The dust cloth layer 24 is applied in a continuous strip to coating 22 while the steel wool layer 26 is simultaneously applied to coating 20. The composite layers 12, 14, 18, 20, 22, 24, 26 are passed through a pair of pressure rollers which causes the pressure sensitive adhesive coatings 20, 22 to bond layer 26 to layer 14 and layer 24 to layer 18. The steel wool layer 26 is impregnated with solution 28 prior to its application to coating 20 by passing layer 26 through a bath of the solution 28.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A buffing pad, which comprises:

a. a steel wool layer;

b. a layer of polyethylene having a front and a rear surface;

c. a first paper layer mechanically bonded to said front surface of said polyethylene layer, said first paper layer adhesively secured to said steel wool layer;

d. a solution of crude drying oil and essence of lemon, said solution impregnated into said steel wool layer;

e. a second paper layer mechanically bonded to said rear surface of said polyethylene; and f. a dust cloth layer, said dust cloth adhesively secured to said second paper layer.

2. A buffing pad according to claim 1, wherein said solution consists essentially of 99.9 parts/100 pounds of said crude drying oil and 0.1 parts/100 pounds of essence of lemon.

* * * * *